US006371583B1

(12) United States Patent
Visin

(10) Patent No.: US 6,371,583 B1
(45) Date of Patent: Apr. 16, 2002

(54) SCREWLESS APPLIANCE CONSOLE ATTACHMENT

(75) Inventor: Jerry M. Visin, Benton Harbor, MI (US)

(73) Assignee: Whirpool Corporation, Benton Harbor, MI (US)

( * ) Notice: Subject to any disclaimer, the term of this patent is extended or adjusted under 35 U.S.C. 154(b) by 0 days.

(21) Appl. No.: 09/562,364

(22) Filed: May 1, 2000

(51) Int. Cl.[7] ..... A47L 17/00
(52) U.S. Cl. ..... 312/228; 312/265.6
(58) Field of Search ..... 248/27.1, 27.3; 312/228, 263, 265.5, 265.6, 257.1, 279, 223.1

(56) References Cited

U.S. PATENT DOCUMENTS 2,839,805 A * 6/1958 Bedford, Jr. ..... 248/27.5
5,230,553 A * 7/1993 Tuller ..... 312/228
5,971,510 A 10/1999 Lickiss et al. ..... 312/263

* cited by examiner

*Primary Examiner*—Peter M. Cuomo
*Assistant Examiner*—Jerry A. Anderson
(74) *Attorney, Agent, or Firm*—Thomas J. Roth; Robert O. Rice; Stephen Krefman

(57) ABSTRACT

An attachment mechanism to secure a console onto an appliance is provided in which the console is mounted without the use of threaded fasteners and, one mounted, the attachment mechanism is hidden from view from the exterior of the appliance. A projection on one of the appliance and console mates with an opening in the other of the appliance and console and a clip extends from one of the appliance and console to mate with an opening in the other of the appliance and console, such that the projection serves to align the two parts and the clip serves to secure the parts together. Preferably the projection and clip, or more than one of each, are located on a mating surface between the appliance and console such that when the console is mounted onto the appliance, the projection and clip can no longer be seen from the exterior of the appliance.

20 Claims, 5 Drawing Sheets

SCREWLESS APPLIANCE CONSOLE ATTACHMENT

BACKGROUND OF THE INVENTION

The present invention relates to an attachment mechanism between a console and an appliance and more particularly to an attachment mechanism that obviates the need for threaded or exposed fasteners.

Many appliances include control consoles which may be formed separately from the remaining cabinetry of the appliance and must be secured to the appliance cabinetry in some fashion. Typically retaining screws or other threaded fasteners are utilized to secure the console to the cabinet.

For aesthetic reasons it has become desirable to hide the fasteners from the view of the consumer. One method of fastening consoles to appliance cabinets which hides the screws involves the use of a decorative trim piece that snaps into the console, covering the screw. However, while this effectively hides the screw, it adds cost to the assembly due to the added trim pieces and the extra labor required to assemble them. Another approach, as disclosed in U.S. Pat. No. 5,971,510, is to locate the threaded fastener in a position, such as on the backside of the console, so that the fastener is not normally seen while the appliance is in use. Such an approach may work for those appliances where one side of the appliance typically is not in the view of the user, however, all appliances do not share this trait.

The use of threaded fasteners, by itself, involves a not inconsiderable cost, beyond just the cost of the threaded fastener and the labor required to assemble it. That is, oftentimes in the assembly process, particularly where the fasteners are attached by a mechanism such as a screw gun, occasionally the driving head of the screw gun slips from the threaded fastener and engages the painted cabinetry, thus damaging the cabinetry and requiring the cabinetry to be scrapped and replaced, considerably adding to the costs.

Therefore, it will be an improvement in the art if an attachment arrangement were provided between a console and an appliance which did not require the use of threaded fasteners and which attachment arrangement is not visible to the user of the appliance.

SUMMARY OF THE INVENTION

The present invention provides an attachment arrangement for an appliance console which avoids the use of threaded fasteners and which also results in a completed attachment where the attachment arrangement is not visible to the user.

In an embodiment of the invention, an attachment mechanism is provided for an appliance which has a separate console mounted on the appliance. The console has a housing and the appliance has a cabinet. At least one hook is provided which projects from one of the housing and the cabinet and an opening is provided in the other of the housing and cabinet to receive the hook such that the housing can pivotally move relative to the cabinet through the engagement of the hook in the opening. A resilient clip is held at one of the housing in the cabinet and an opening in the other of the housing in the cabinet is provided to receive the clip such that the clip will deform as it is inserted into the opening and will move back towards its non-deformed shape upon full insertion into the opening, wherein the clip will be captured in the opening and the console will be held onto the appliance. The resilient clip has sufficient give to it to permit the console housing to be moved slightly away from the appliance cabinet to allow the insertion of a thin tool, such as a screw driver or putty knife, to deform the clip sufficiently to permit it to release from the opening and to allow the console housing to pivot away from the appliance cabinet for removal of the console from the cabinet.

When the console housing is secured to the cabinet through the connection of the hook and the clip, both the hook and the clip will be hidden in the engaged area between the console housing and the appliance cabinet so that the fastening arrangement will be hidden from view from the user.

Preferably the hook and the resilient clip are formed or provided at the console housing with the openings being provided in the appliance cabinet, although either or both of the hook and clip placements could be reversed.

In certain appliances, such as washing machines and dryers, typically the console is secured to a top surface of the appliance cabinet with a bottom surface of the console being secured to the top surface of the appliance. In other appliances, such as dishwashers, ovens and other appliances, the console appears on a front surface of the appliance with the back of the console engaging the front surface of the appliance. The present invention can be used for any such appliances where one surface of the console engages a surface of the appliance whether it is the top surface of the appliance, the front surface of the appliance or any other surface.

To further stabilize the attachment, additional projections and openings can be provided such as multiple hooks and multiple clips as well as other locating pins.

DETAILED DESCRIPTION OF THE PREFERRED EMBODIMENTS

Figure 1:
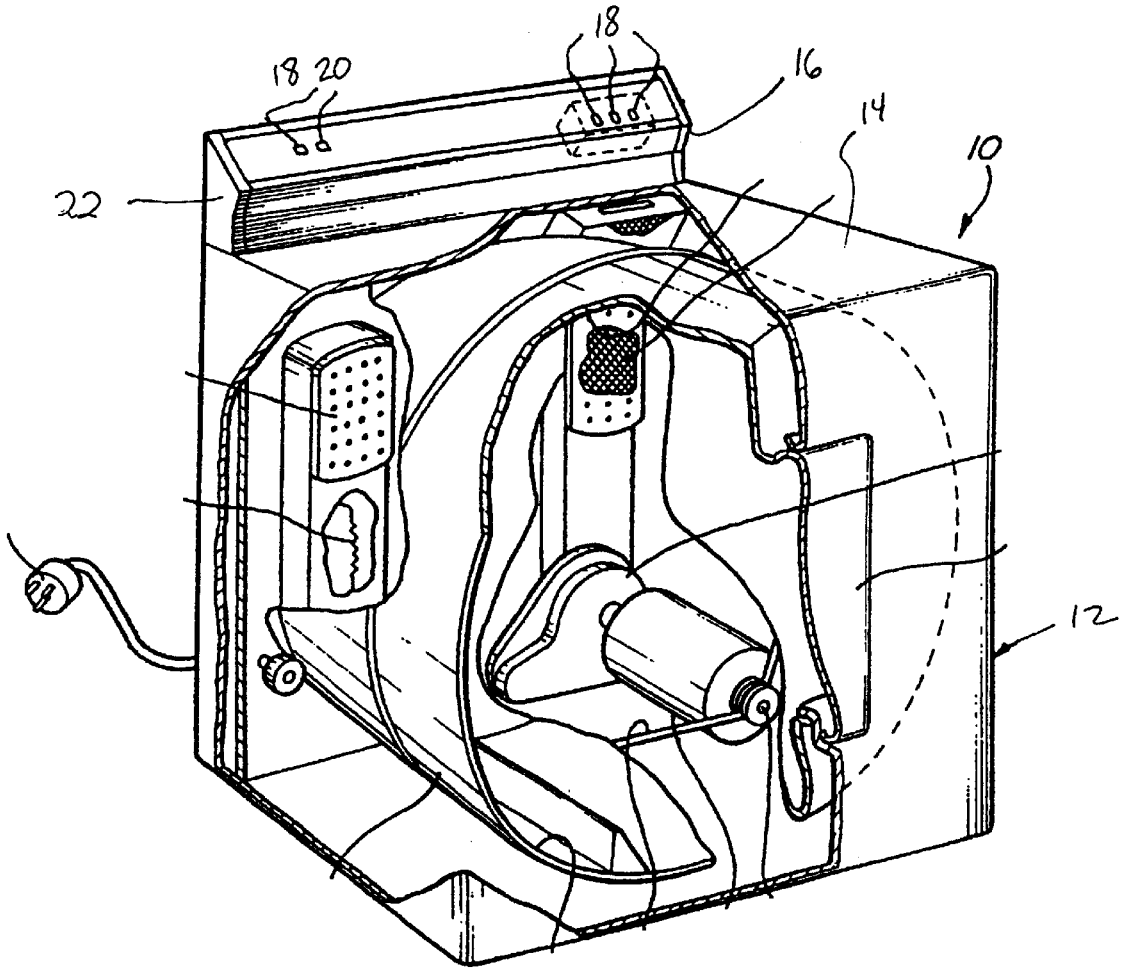
FIG. 1 is a perspective view of an appliance having a console.

In FIG. 1 there is illustrated an appliance generally at 10 which, in this illustration, comprises an electric clothes dryer. The present invention can be used in a wide range of appliances including clothes dryers, automatic clothes washers, dishwashers, trash compactors, water dispensers, ovens, stoves, refrigerators, freezers, microwave ovens, clothes refreshers, and virtually any other type of appliance having a control console which is to be attached to the remainder of the appliance. Thus, although the present invention is illustrated herein, for environmental purposes, in connection with particular appliances such as clothes dryers and clothes washers, it should be understood that the invention is not limited to use in the particular identified appliances.

The appliance 10 in FIG. 1 includes a cabinet 12 formed of several panels, including a top panel 14. A control console 16 is provided having a plurality of user operable controls 18 thereon as well as various indicators 20 to inform the user of the status of operation of the appliance. The console 16 includes a housing 22 on which the various controls 18 and indicators 20 are secured. The console housing 22 is attached to the cabinet 12 of the appliance in a secured manner. Console housing 22 may be a panel and end cap structure as is well known in the appliance art. While it may be desirable for maintenance or repair operations to detach the console 16 from the remainder of the appliance 10, generally the console is to remain fixed to the appliance.

The present invention is directed to an attachment mechanism between the console 16 and the appliance 10 which avoids the use of threaded fasteners and which cannot be seen from the exterior of the appliance, and thus is not visible in FIG. 1.

Figure 2:
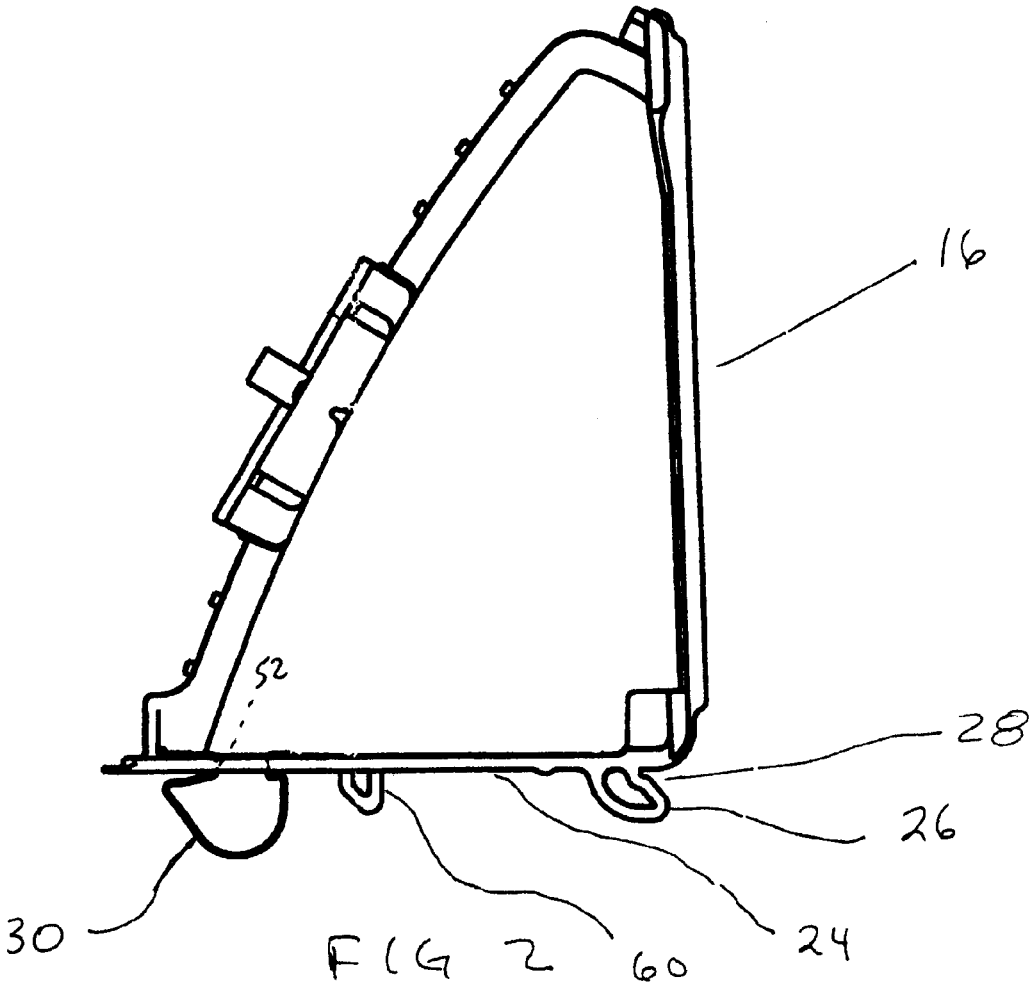
FIG. 2 is an end view of a console separate from the appliance and illustrating a portion of an embodiment of the attachment mechanism of the present invention.
Figure 4:
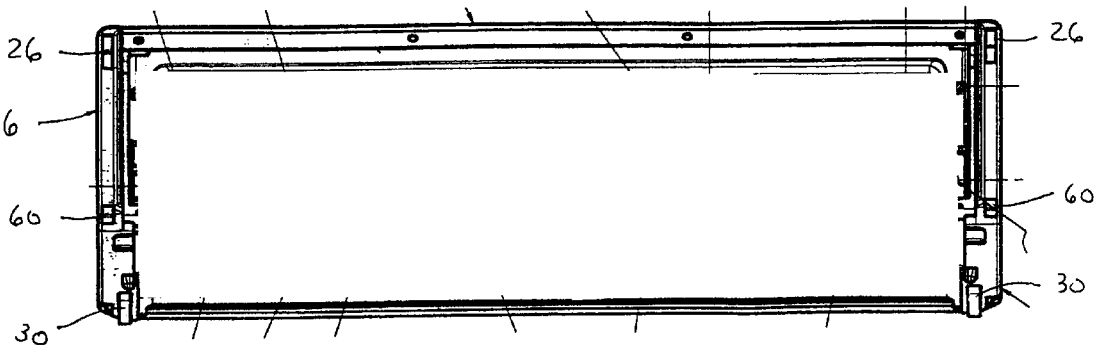
FIG. 4 is a bottom view of the console of FIG. 2.

FIG. 2 illustrates an end view of the console 16 before its attachment to the appliance 10 and FIG. 4 illustrates a bottom view of the console 16. In this embodiment, the console includes a bottom surface 24 which is designed to abut against the top panel 14 of the appliances illustrated in FIG. 1.

The console 16 has a hook 26 projecting from the bottom surface 26. This hook can be formed integrally with the surface 24 or can comprise a separate piece inserted into and secured relative to the bottom surface 24 or some other portion of the housing. As illustrated in this embodiment, the hook has a rearward facing opening 28, the function of which will be described below.

Also projecting from the bottom surface is a resilient clip 30, again which can be formed integrally with the bottom surface 24 or can be a separate member inserted into and secured to the bottom surface or some other portion of the housing.

Figure 3:
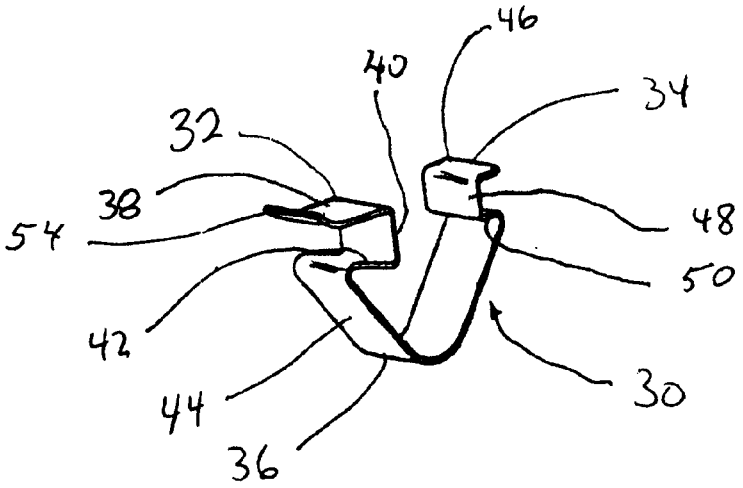
FIG. 3 is a perspective view of an embodiment of a clip which can be used in the attachment mechanism of the present invention.

FIG. 3 illustrates an example of a clip 30 which can be used with the present invention. In this embodiment, the hook has a generally U-shaped configuration with a first end 32 and a second end 34 connected by a bight 36. In an embodiment, the clip can be formed of a resilient metal material or a resilient plastic material such that it can be deformed from a normal shape by an appropriate force and, when the force is removed, the clip will return toward its non-deformed shape.

In the embodiment illustrated in FIG. 3, the first end 32 includes a horizontal segment 38 connected to a vertical segment 40 which connects to an essentially horizontal segment 42 which connects, at a bend, to a continuous segment 44 forming the bight 36. The second end 34 includes a horizontal segment 46 connected by a bend to a vertical segment 48 which is connected by a bend to another essentially horizontal segment 50 which then connects by a bend to the segment 44 forming the bight.

As illustrated in FIG. 2, the clip 30 can be inserted into an opening 52 formed in the bottom surface 24 of the console 16 by pressing the two ends 32, 34 toward each other to deform the clip and allowing a portion of it to pass through the opening 52. When the deforming force is removed, the clip moves back toward the non-deformed shape and the bottom surface 24 will be captured in the area provided by the vertical segments 40, 48. The vertical segments 40, 48 are taller than the thickness of the bottom surface 24 for capturing a part of the appliance cabinet as described in greater detail below.

A portion of the first end 32 can be slightly upturned as at 54 to permit the clip 30 to be removed from the bottom surface 24 through the operation of a thin tool such as a screw driver or putty knife. The tool can slide under the horizontal segment 38 to engage the vertical segment 40 to apply a rearwardly directing deforming force to squeeze the clip together to permit it to disengage from the opening 52.

The console 16 may also have an additional projection 60 extending from the bottom surface 24 for engagement into an appropriate opening in the appliance cabinet 12, as described below, to provide additional alignment and stability to the connection between the console 16 and the appliance 10.

In a preferred embodiment, the console may have two hooks 26 and two clips 30, one of each positioned at each lateral end of the console for attachment of the console to the appliance. Depending upon the particular application, the console may be provided with only one hook or clip or more than two of each. Also, the console may be provided with one or more locating and stabilizing projections 60 as deemed necessary or desirable.

Figure 5:
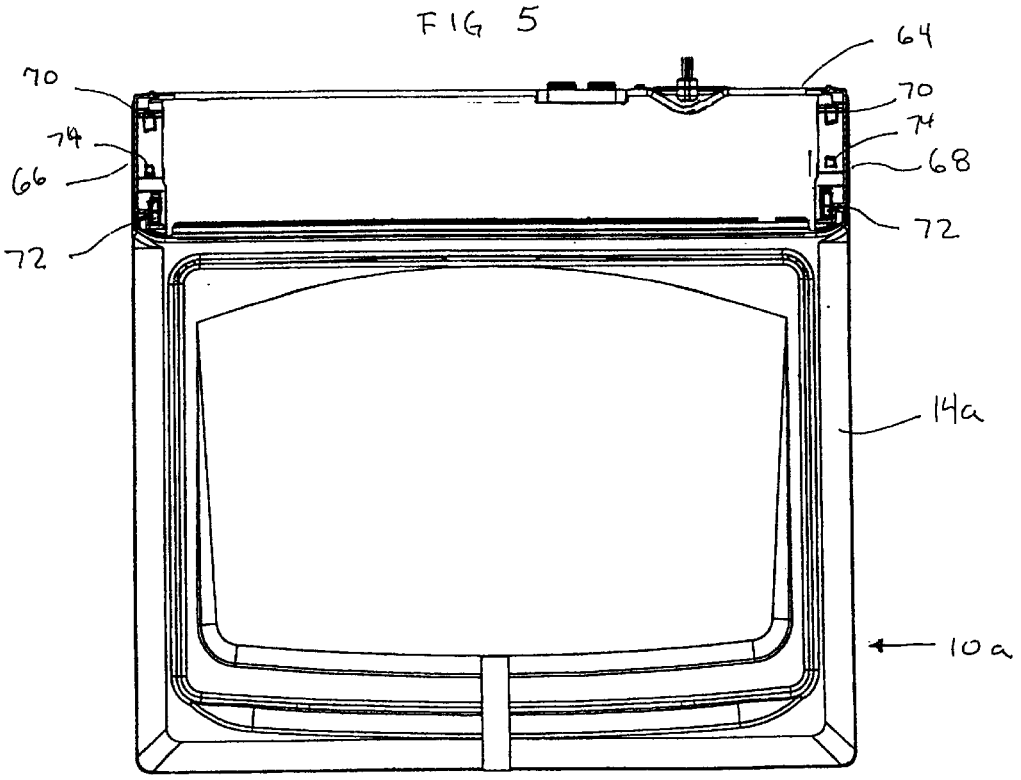
FIG. 5 is a top view of an appliance cabinet without a console mounted thereon and illustrating a further portion of an embodiment of the attachment mechanism of the present invention

FIG. 5 illustrates a top view of a top panel 14*a* of an appliance 10*a*, in this instance, a top loading clothes washer. In this particular appliance the console, which is not present in this view, is located near a rear side 64 of the appliance and, again in this particular appliance, extends from a left side 66 to a right side 68. Of course, consoles may be provided which extend less than a full width of an appliance or which may be attached to other portions of the appliance.

Figure 6:
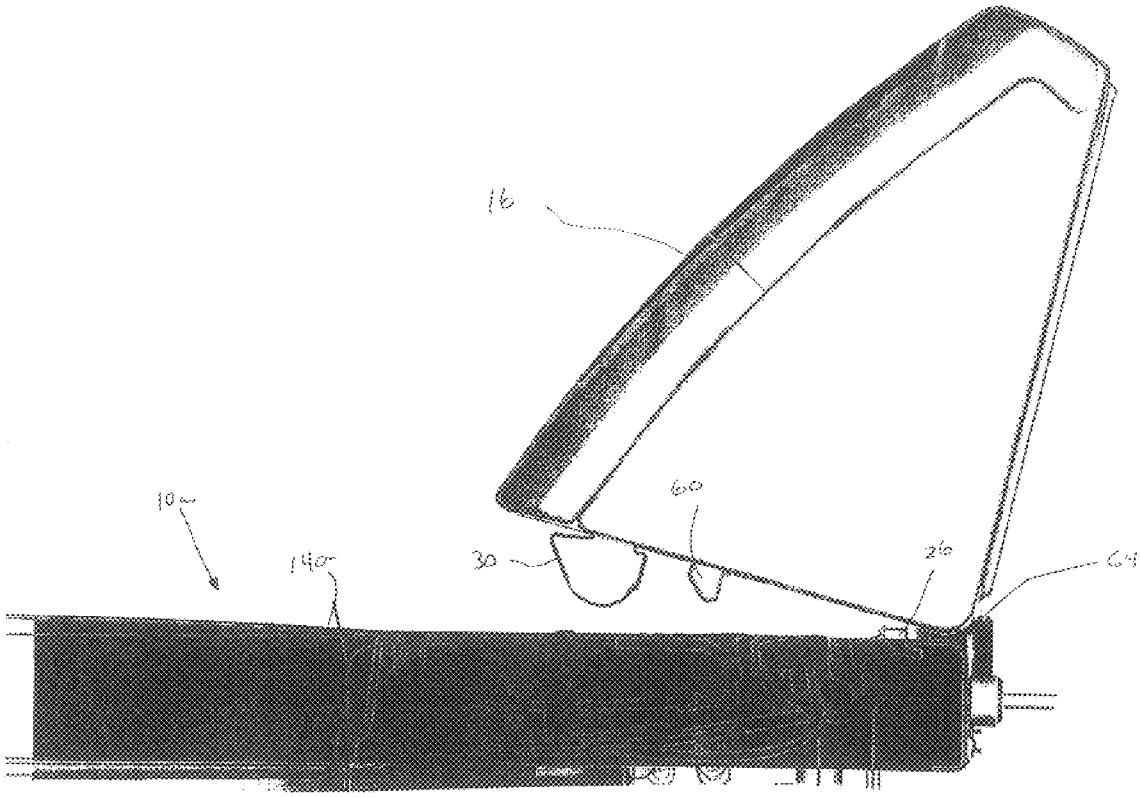
FIG. 6 is a partial side view of an appliance cabinet with a console in the process of being mounted thereon with an embodiment of the attachment mechanism of the present invention.

In the embodiment illustrated in FIG. 5, the top panel 14*a* includes at least one first opening 70, here one located adjacent the left side 66 and one located adjacent the right side 68. These openings 70 are sized to receive the hook 26 from the console. A rear edge of the opening 70 is received in the open side 28 of the hook thus providing a point for a pivotal engagement between the hook and opening, permitting the console housing to pivot relative to the appliance cabinet through the engagement of the hook 26 in the opening 70 as illustrated in FIG. 6. In other embodiments the hook 26 may have a different configuration than shown, that is, the open side 28 may face forward rather than rearward so that the console would pivot in an opposite direction, or the open side may be configured differently, even in a straight line rather than concave as shown, such as a straight cylindrical peg or rectangular peg. These latter configurations are less desirable in that the user is not assisted in locating a proper pivot point, but they could be used nevertheless.

In the embodiment of FIG. 5, at least one second opening 72 is provided, again one adjacent the left side 66 and one adjacent the right side 68. The second opening 72 is sized to receive the resilient clip 30, but only when the resilient clip is deformed from its normal position. In the embodiment illustrated, the opening 72 does not extend in a front to rear direction by a length sufficient for the clip to be inserted into the opening undeformed, and it is only when the clip is deformed, by moving the first end 32 toward the second end 34, that the clip will be able to pass through the opening 72. This deformation and movement is facilitated by the clip as shown in the embodiment of FIGS. 2 and 3 in that the segment 44 forming the bight 36 includes a sloped or tapered portion which, upon insertion of the clip 30 into the opening 72 will result in a camming action forcing the first end 32 and second end 34 to move toward each other, allowing the clip to insert into the opening 72. Once the bight segment 44 has passed through the opening, the clip will move back toward its non-deformed shape and the panel 14*a* surrounding the opening 72 will be captured in the space provided by the vertical segments 40 and 48, along with the bottom surface 24 of the console, thus securing the console to the appliance cabinet.

Figure 7:
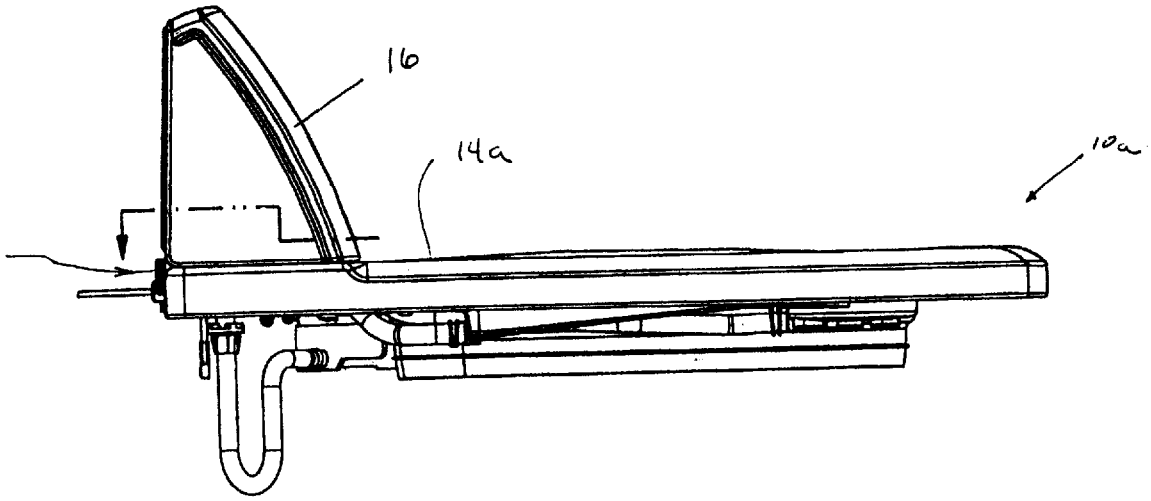
FIG. 7 is a partial side view of an appliance housing with the console fully mounted thereon.

Once the console has been pivoted down into engagement with the appliance cabinet, both the hook 26 and the clip 30 will no longer be visible from the exterior of the appliance, thus rendering the attachment mechanism invisible to the user as shown in FIGS. 1 and 7.

The appliance may be provided with an additional opening or openings 74, again on one or both lateral sides, or other locations of the appliance cabinet, to receive any locating and stabilizing projections 60 which may be provided at the console.

The resilient clip 30 should be sufficiently flexible to permit a slight movement of the console 16 relative to the appliance 10, upon application of sufficient force, to provide a slight gap between the console and the appliance at their mating surfaces to permit the insertion of a relatively flat tool such as a screw driver or putty knife or similar device into engagement with the clip 30 to permit the clip to be deformed an amount sufficient to cause it to be released from engagement with the appliance panel 14 and permitting it to be extracted through the opening 72 such that the console 16 can be removed from the appliance 10 for repair, replacement or maintenance.

Although in the above illustrated embodiments the hook 26 and the clip 30 both project from the console housing and the receiving openings 70, 72 are formed in the appliance cabinet, the positions of either or both could be reversed. That is, one or both openings could be provided at the console and either the hook or clip, or both, could project from the appliance cabinet. The same is also true with respect to the optional locating and stabilizing projection 60 and its corresponding receiving opening 74.

Also, although in the particular embodiments illustrated the appliance cabinet is formed of multiple flat panels and the housing also has flat panels, the particular size, shape and layout of the appliance cabinet and console housing are not critical, so long as at least one surface area of the console housing can engage with a corresponding surface area on the appliance cabinet. Further, although the appliance cabinet is illustrated as being formed of relatively thin sheet metal such construction is similarly not critical, so long as there is some portion of the appliance or console for the hook and the clip to engage into.

Further, the clip 30 is illustrated as a resilient member which is moved between a deformed shape to insert into openings and toward a non-deformed shape to be held in the openings. The clip could also be formed and attached in other ways to move between an insertion position and a securing position, such as by pivoting, rotating, sliding or other movements to secure the parts without the use of visible threaded fasteners.

As is apparent from the foregoing specification, the invention is susceptible of being embodied with various alterations and modifications which may differ particularly from those that have been described in the preceding specification and description. It should be understood that I wish to embody within the scope of the patent warranted hereon all such modifications as reasonably and properly come within the scope of my contribution to the art.

The embodiments of the invention in which an exclusive property or privilege is claimed are defined as follows:

1. An attachment means for removably mounting and securing a separable console housing on an appliance cabinet comprising:

at least one hook projecting from one of said housing and said cabinet;

a hook opening in the other of said housing and cabinet to receive said hook such that said housing can pivotally move relative to said cabinet through the engagement of said hook in said hook opening;

a resilient clip projecting from one of said housing and said cabinet; and a clip opening in the other of said housing and said cabinet to receive said clip such that said clip will deform as said clip is inserted into said clip opening and said clip will move back towards its non-deformed shape upon full insertion into said clip opening wherein said clip will be captured in said clip opening and thereby secure said housing onto said cabinet and wherein removal means can be inserted between said housing and said cabinet to deform said resilient clip to permit withdrawal of said resilient clip from said clip opening and thereby permit pivotal movement of said housing relative to said cabinet for removal of said housing from said cabinet.

2. An attachment means according to claim 1, wherein said hook projects from said housing.

3. An attachment means according to claim 1, wherein said resilient clip projects from said housing.

4. An attachment means according to claim 1, wherein said housing has a bottom surface and said hook and hook opening engagement occurs at said bottom surface.

5. An attachment means according to claim 1, wherein said cabinet has a top surface and said hook and hook opening engagement occurs at said top surface.

6. An attachment means according to claim 1, wherein said console has a front edge and a rear edge and a bottom surface, said engagement between said hook and hook opening occurs at said bottom surface near said rear edge and said engagement between said clip and said clip opening occurs at said bottom surface near said front edge.

7. An attachment means according to claim 1, wherein said housing comprises a pair of end caps and at least one panel extending between said end caps, two of said hooks and two of said clips being provided, with one of said hooks and one of said clips at each end cap.

8. An attachment means according to claim 1, wherein an alignment projection is provided on one of said housing and said cabinet and a corresponding projection opening is provided on the other of said housing and said cabinet to receive said projection when said console is mounted to said appliance.

9. An attachment means according to claim 1, wherein said hook is provided with a concave surface area for engagement with a side of said hook opening.

10. An attachment means according to claim 1, wherein said resilient clip is formed separately from either of said appliance and console, and is held in place in said appliance and console as a result of deformation of a shape of said clip as said clip is inserted into said appliance and console and subsequent movement of said clip back towards its non-deformed shape upon full insertion of said clip into said clip opening.

11. An attachment means according to claim 1, wherein said hook is formed integrally with one of said appliance and console and is loosely received in the hook opening of the other of said appliance and console.

12. An attachment means for removably mounting and securing a console housing formed of two end caps and at least one panel extending therebetween to an appliance cabinet having a console receiving surface, comprising:

a hook projecting from a surface of each end cap of said housing; hook openings in said cabinet surface to receive said hooks such that said housing can pivotally move relative to said cabinet through the engagement of said hooks in said hook openings;

a resilient clip held in each end cap of said housing; clip openings in said cabinet surface to receive said clips such that said clips will deform as said clips are inserted into said clip openings and each of said clips will move back towards its non-deformed shape upon full insertion into said clip openings wherein said clips will be captured in said opening and thereby secure said housing onto said cabinet and wherein removal means can be inserted between said housing and said cabinet surface to deform said resilient clips to permit withdrawal of said clips from said clip openings and thereby permit pivotal movement of said housing relative to said cabinet for removal of said console from said cabinet.

13. An attachment means according to claim 12, wherein said resilient clip comprises a separate clip secured in said end cap.

14. An attachment means according to claim 12, wherein said end caps each have a bottom surface and said hook and clip project from said bottom surface and said appliance cabinet has a top surface and said hook and clip openings are located in said top surface.

15. An attachment means according to claim 12, wherein each of said hooks is formed integrally with one of said end caps.

16. An appliance having a separable console removably mounted thereon by attachment means, comprising:

at least one first projection projecting from one of said appliance and said console;

at least one first opening in the other of said appliance and console to receive said projection such that said console can pivotally move relative to said appliance through the engagement of said first projection in said first opening;

at least one resilient clip projecting from one of said appliance and console; and at least one second opening in the other of said housing and said cabinet to receive said clip in a first position of said clip and to hold said clip in a second position of said clip thereby securing said console on said appliance;

said projection, clip and openings being located at mating surfaces of said appliance and said console such that when said console is mounted on said appliance, said attachment means is concealed from view from an exterior of said appliance and wherein removal means can be inserted between said appliance and said console to move said clip back toward said first position to permit withdrawal of said clip from said second opening and thereby permit pivotal movement of said console relative to said appliance for removal of said console from said appliance.

17. An appliance according to claim 16, wherein said appliance has a cabinet to which said console is mounted.

18. An appliance according to claim 16, wherein said console has a housing which is mounted to said appliance.

19. An appliance according to claim 16, wherein said first projection comprises a hook.

20. An appliance according to claim 16, wherein said clip is resilient and said first position of said clip is a deformed shape of said clip and said second position of said clip is a shape closer to a non-deformed shape of said clip.

* * * * *